United States Patent [19]

Berens et al.

[11] 4,362,634

[45] Dec. 7, 1982

[54] METAL WORKING LUBRICANT AND LUBRICANT EMULSION

[75] Inventors: George Berens, Bardonia; Frank L. Padovani, Pleasantville; Peter E. Timony, Valley Cottage, all of N.Y.

[73] Assignee: Stauffer Chemical Company, Westport, Conn.

[21] Appl. No.: 131,620

[22] Filed: Mar. 19, 1980

[51] Int. Cl.[3] ..... C10M 1/06; C10M 1/10

[52] U.S. Cl. ..... 252/49.5; 252/49.8

[58] Field of Search ..... 252/49.5, 49.8

[56] References Cited

U.S. PATENT DOCUMENTS

| | | | |
|---|---|---|---|
| 3,526,596 | 9/1970 | Kress et al. | 252/49.8 X |
| 3,532,632 | 10/1970 | Sugarman et al. | 252/49.8 X |
| 3,701,730 | 10/1972 | Daniels et al. | 252/49.9 |
| 3,923,671 | 12/1975 | Knapp | 252/49.5 |
| 3,959,187 | 5/1976 | Kardol et al. | 252/49.5 X |
| 3,970,570 | 7/1976 | Pratt et al. | 252/49.8 X |

*Primary Examiner*—Robert V. Hines

*Attorney, Agent, or Firm*—Roger S. Benjamin

[57] ABSTRACT

A metal-working lubricant contains as essential ingredients (1) polyol ester, (2) triaryl phosphate, (3) a sorbitan type or glycerol ester type nonionic surfactant. The metal working lubricant may be used neat or as a stable lubricant emulsion.

13 Claims, No Drawings

METAL WORKING LUBRICANT AND LUBRICANT EMULSION

Conventional metal working operations with aluminum and steel require a variety of lubricants as hydraulic fluids, cutting fluids, grinding fluids, etc.

Aqueous lubricant emulsions are used in metal working operations because they combine the valuable properties of lubricity and efficient heat removal. Other metal working operations require more conventional non-aqueous lubricants.

A sequence of metal working operations employing different lubricants may contaminate each other to give unwanted results. It has been proposed to overcome the problems associated with different or incompatible metal working lubricants by using neat and emulsified forms of the same mineral oil based lubricant for all metal working process steps (see, U.S. Pat. No. 3,923,671). Unfortunately, mineral oil based products are substantially inert and tend to escape to the environment in the recycle and cleaning steps of the metal working process. It is desirable to provide lubricants which are alternatives to mineral oil based products.

FIELD OF THE INVENTION

This invention relates to metal working lubricants in neat or emulsified form.

THE INVENTION

This invention is a novel polyol ester/triaryl phosphate based metal working lubricant. Another aspect of this invention is a novel metal working lubricant aqueous emulsion.

In addition, this invention is an improved method of metal working wherein the metal working operations are lubricated by polyol ester/triaryl phosphate based lubricant or an aqueous emulsion of said lubricant.

DETAILED DESCRIPTION OF THE INVENTION

Metal working includes the processes of machining, grinding, stamping, blanking, drawing, ironing, spinning, extruding, molding forging, and rolling. The composition and processes described by this invention find particular application in metal processing and machinery for sheet metal stock composed of steel or aluminum.

The metal working lubricant of this invention contains as its three essential ingredients (1) a polyol ester, (2) a triaryl phosphate, and (3) a surfactant.

The major ingredient of the metal working lubricant is a polyol ester formed by the esterification of an aliphatic polyol with carboxylic acid. The aliphatic polyol reactant contains from 3 to 15 carbon atoms and has from 3 to 8 esterifiable hydroxyl groups. Examples of preferred polyols are trimethylolpropane, pentaerythritol, dipentaerythritol, tripentaerythritol, and mixtures thereof.

The carboxylic acid reactant is selected from (1) aliphatic monocarboxylic acid, or (2) a mixture of aliphatic monocarboxylic acid and aliphatic dicarboxylic acid. The monocarboxylic acid contains from 4 to 18 carbon atoms and mixtures of monocarboxylic acids may be used if desired. Suitable monocarboxylic acids include hexanoic acid, heptanoic acid, nonanoic acid, and mixtures thereof. A mixture of monocarboxylic acid and dicarboxylic acid may be used if a product of increased viscosity is desired. The proportion of dicarboxylic acid in the monocarboxylic/dicarboxylic acid mixture is limited by the proviso that on the average not more than one of the average number of hydroxyl groups in the polyol is esterified by the dicarboxylic acid. Suitable dicarboxylic acids are aliphatic acids of 3 to 12 carbon atoms. Mixtures of dicarboxylic acids may be used if desired. Preferred dicarboxylic acids are adipic and azelaic acid.

The aliphatic polyol may be fully or partially esterified by carboxylic acid to yield the polyol ester lubricant ingredient. Alternatively, the polyol ester ingredient may be a mixture of fully and partially esterified polyols.

The polyol ester is a liquid product having a viscosity in the range of 3 to 16 cst. at 210° F. An additional characteristic of the polyol ester is that it is readily hydrolyzed in the presence of strong mineral acids to yield its original polyol and carboxylic acid reactants.

The polyol ester constitutes from about 60 to about 90, and preferably from 70 to 85, weight percent of the three essential ingredients in the metal working lubricant.

The second essential ingredient of the metal working composition is a triaryl phosphate of the general formula:

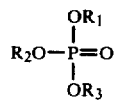

wherein $R_1$, $R_2$, and $R_3$ may be the same or different radical selected from phenyl, cresyl, xylyl, toluyl, isopropylphenyl, tertiary butylphenyl, tertiary nonylphenyl and secondary butylphenyl. The triaryl phosphate constitutes from about 1 to about 10, and preferably from 3 to 8 weight percent of the three essential ingredients in the metal working lubricant.

The third essential ingredient of the metal working lubricant is a surfactant. The surfactant must be selected from carboxylic ester nonionic surfactants of the anhydrosorbitol ester or glycerol ester types (as described in the Encyclopedia of Chemical Technology 2'nd Edition, Volume 19 pages 537 to 548 editor, Kirk-Othmer; Interscience Publishers, New York, NY; the disclosure of which is incorporated herein by reference).

A large number of surfactants tested (viz., various sulfonated detergents) were incompatible with the polyol ester/triaryl phosphate components of the neat metal working lubricant and/or cause phase separation in less than one hour when the neat lubricant is emulsified in water. It is a discovery of this invention that the anhydrosorbitol ester or glycerol ester type carboxylic acid ester nonionic detergents have the required properties of compatability and stable emulsion formation in the metal working lubricants of this invention.

The surfactant ingredient should constitute from about 5 to about 30, and preferably from 10 to 25, weight percent of the three essential ingredients in the lubricant composition.

The lubricant composition may contain a variety of optional ingredients conventional to lubricant formulations. Examples of such ingredients are antifungal agents, antibacterial agents, dyes, perfumes, and corrosion inhibitors. Generally, these optional ingredients will comprise less than five weight percent of the total neat metal working lubricant. The metal working lubricant is capable of being used neat (substantially absent water) as a lubricant for machinery or as a hydraulic fluid. The viscosity of of the neat lubricant will generally be in the range of 3 to 30 cst. at 210° F. for conventional metal working operations. The viscosity of the neat lubricant is easily adjusted by changing the proportion of ingredients within the suggested compositional limits and/or by selection of polyol, carboxylic acid or dicarboxylic acid used in the formation of the polyol ester ingredient.

The neat metal working lubricant may be employed in a metal working process by contacting sheet metal stock or metal working machinery with the neat lubricant in any conventional manner such as spraying, coating, etc.

THE AQUEOUS LUBRICANT EMULSION

The "neat" polyol ester/triaryl phosphate based lubricant described in the preceding section may be dispersed in water to form a stable emulsion.

The term "emulsion" as used herein refers to any stable and uniform dispersion, suspension, or emulsion of the neat lubricant in water or water in the neat lubricant.

The aqueous emulsion form of the lubricant of this invention is particularly applicable to metal working operations which generate waste materials. For example, in the drawing and ironing of aluminum sheet stock the lubricant emulsion may be applied to presses, punches, draw dies, ironing dies, etc. The metal parts may be cleaned by continuously washing away metal fines and filtering the lubricant before recirculation.

The metal working lubricant emulsion is prepared by dispersing the lubricant in water with the aid of strong agitation means such as provided by conventional impellers or ultrasonic devices.

The concentration of neat lubricant in the lubricant emulsion is from 2 to about 30 weight percent, with concentrations of 3 to 20 weight percent being preferred. The emulsified form of the lubricant of this invention should be phase stable for a period of at least one hour under quiescent conditions, although the lubricant emulsion will generally be used under conditions of constant agitation. The metal working lubricant emulsion is employed in a metal working process by contacting sheet metal stock or metal working machinery with the lubricant emulsion in any conventional manner such as spraying, coating, etc. Continuous circulation and purification of the lubricant emulsion is advisable and dissipation of accumulated heat by heat exchange means is sometimes necessary.

At the conclusion of the metal working process adherent lubricant is removed from the shaped metal products by chemical or mechanical cleaning means.

It is a particular advantage of this invention that the conventional acid cleaning treatment for steel and aluminum is effective in degrading the major polyol ester component of the lubricant.

The following Example illustrates the practice the invention.

EXAMPLE

This Example describes the preparation of a neat metal working lubricant and a lubricant emulsion.

A metal working lubricant component was prepared by combining the following ingredients:

| | |
|---|---|
| BASESTOCK 810 TM brand of penaterythritol/fatty acid ester (product of Stauffer Chemical Co.) | 95 parts by weight |
| Monotertiarybutylphenyl/diphenyl phosphate | 5 parts by weight |

The lubricant component was mixed with the proportions and types of surfactants shown in the TABLE to give phase stable neat metal working lubricants. Fifteen parts by weight of the phase stable neat lubricant was charged with 85 parts by weight of water to the mixing vessel of an electric blender. The materials were mixed at high speed for one minute. The experimental results are set out in the TABLE below:

TABLE

ONE HOUR EMULSION STABILITY TEST OF 15% NEAT LUBRICANT IN WATER

| Surfactant | Weight % Emulsifier in Neat Lubricant | | |
|---|---|---|---|
| Type | 10 | 20 | 30 |
| Sorbitan Monotallate[1] | Stable | Stable | Stable |
| Polyglycerol Fatty Acid Ester[2] | Stable | Stable | Stable |
| Polyoxyethylene Sorbitan Oleate[3] | Unstable | Unstable | Unstable |

[1]WITCOMUL 78 TM emulsifier, product of Witco Chemical Co.
[2]WITCOMUL 14 TM emulsifier, product of Witco Chemical Co.
[3]WITCONUL AL 6966 TM emulsifier, product of Witco Chemical Co.

The sorbitan type and polyglycerol fatty acid ester type surfactants gave stable emulsions of the neat lubricant formulations. A related polyoxyethylene sorbitan oleate nonionic surfactant failed to give a stable emulsion.

Although the invention has been described with respect to certain preferred embodiments, it should be understood that modifications obvious to one having ordinary skill of the art may be made without deviating from the scope of the invention which is defined by the following claims.

What is claimed:

1. A metal working lubricant comprising:

(a) about 60 to about 90 weight percent of a polyol ester derived from the esterification of aliphatic polyol with aliphatic carboxylic acid, wherein said aliphatic carboxylic acid is (i) an aliphatic monocarboxylic acid of 4 to 18 carbon atoms; or (ii) a mixture of an aliphatic monocarboxylic acid of 4 to 18 carbon atoms and an aliphatic dicarboxylic acid of 3 to 12 carbon atoms, with the proviso that the proportion of dicarboxylic acid in said mixture is such that on the average not more than one of the average number of hydroxyl groups in the polyol is esterified by said dicarboxylic acid;

(b) about 1 to about 10 weight percent of a triaryl phosphate represented by the formula:

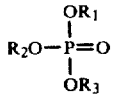

wherein $R_1$, $R_2$, and $R_3$ may be the same or different radical selected from the group consisting of phenyl, cresyl, xylyl, toluyl, isopropylphenyl, tertiary butylphenyl, tertiary nonylphenyl and secondary butylphenyl; and (c) about 5 to about 30 weight percent of a carboxylic ester nonionic surfactant selected from the group consisting of the anhydrosorbitol ester type and the glycerol ester type.

2. The lubricant of claim 1 wherein the polyol used in the formation of the polyol ester is selected from the group consisting of trimethylolpropane, pentaerythritol, dipentaerythritol, tripentaerythritol, and mixtures thereof.

3. The lubricant of claim 1 wherein the dicarboxylic acid is selected from the group consisting of adipic acid and azelaic acid; and the monocarboxylic acid is selected from the group consisting of hexanoic acid, heptanoic acid and nonanoic acid.

4. The lubricant of claim 1 wherein the surfactant is a sorbitan monotallate.

5. The lubricant of claim 1 wherein the surfactant is a polyglycerol fatty acid ester.

6. A lubricant emulsion comprising water having dispersed therein from 2 to about 30 weight percent of a neat metal working lubricant comprising:

(a) about 60 to about 90 weight percent of a polyol ester derived from the esterification of aliphatic polyol with aliphatic carboxylic acid, wherein said aliphatic carboxylic acid is (i) an aliphatic monocarboxylic acid of 4 to 18 carbon atoms; or (ii) a mixture of an aliphatic monocarboxylic acid of 4 to 18 carbon atoms and an aliphatic dicarboxylic acid of 3 to 12 carbon atoms, with the proviso that the proportion of dicarboxylic acid in said mixture is such that on the average not more than one of the average number of hydroxyl groups in the polyol is esterfied by said dicarboxylic acid;

(b) about 1 to about 10 weight percent of a triaryl phosphate represented by the formula:

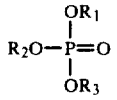

wherein $R_1$, $R_2$, and $R_3$ may be the same or different radical selected from the group consisting of phenyl, cresyl, xylyl, toluyl, isopropylphenyl, tertiary butylphenyl, tertiary nonylphenyl, and secondary butylphenyl; and (c) about 5 to about 30 weight percent of a carboxylic ester nonionic surfactant selected from the group consisting of the anhydrosorbitol ester type and the glycerol ester type.

7. The lubricant emulsion of claim 6 wherein the polyol used in formation of the polyol ester is selected from the group consisting of trimethylolpropane, pentaerythritol, dipentaerythritol, tripentaerythritol, and mixtures thereof.

8. The lubricant emulsion of claim 6 wherein the dicarboxylic acid is selected from the group consisting of adipic acid and azelaic acid; and the monocarboxylic acid is selected from the group consisting of hexanoic acid, heptanoic acid and nonanoic acid.

9. The lubricant emulsion of claim 6 wherein the surfactant is a sorbitan monotallate.

10. The lubricant emulsion of claim 6 wherein the surfactant is a polyglycerol fatty acid ester.

11. An improved method of lubricating metal working machinery and sheet metal stock by contacting said machinery and sheet metal stock with a liquid polyol ester containing lubricant; wherein the improvement comprises using as lubricant the composition comprising:

(a) about 60 to about 90 weight percent of a polyol ester derived from the esterification of aliphatic polyol with aliphatic carboxylic acid, wherein said aliphatic carboxylic acid is (i) an aliphatic monocarboxylic acid of 4 to 18 carbon atoms; or (ii) a mixture of an aliphatic monocarboxylic acid of 4 to 18 carbon atoms and an aliphatic dicarboxylic acid of 3 to 12 carbon atoms, with the proviso that the proportion of dicarboxylic acid in said mixture is such that on the average not more than one of the average number of hydroxyl groups in the polyol is esterified by said dicarboxylic acid;

(b) about 1 to about 10 weight percent of a triaryl phosphate represented by the formula:

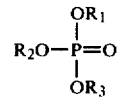

wherein $R_1$, $R_2$, and $R_3$ may be the same or different radical selected from the group consisting of phenyl, cresyl, xylyl, toluyl, isopropylphenyl, tertiarybutylphenyl, tertiary nonylphenyl and secondary butylphenyl; and (c) about 5 to about 30 weight percent of a carboxylic ester nonionic surfactant selected from the group consisting of the anhydrosorbitol ester type and the glycerol ester type.

12. An improved method of lubricating metal working machinery and sheet metal stock by contacting said machinery and sheet metal stock with an aqueous lubricant emulsion; wherein the improvement comprises using as lubricant an emulsion comprising water having dispersed therein from 2 to about 30 weight percent of a neat metal working lubricant comprising:

(a) about 60 to about 90 weight percent of a polyol ester derived from the esterification of aliphatic polyol with aliphatic carboxylic acid, wherein said aliphatic carboxylic acid is (i) an aliphatic monocarboxylic acid of 4 to 18 carbon atoms; or (ii) a mixture of an aliphatic monocarboxylic acid of 4 to 18 carbon atoms and an aliphatic dicarboxylic acid of 3 to 12 carbon atoms, with the proviso that the proportion of dicarboxylic acid in said mixture is such that on the average not more than one of the average number of hydroxyl groups in the polyol is esterified by said dicarboxylic acid;

(b) about 1 to about 10 weight percent of a triaryl phosphate represented by the formula:

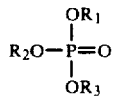

wherein $R_1$, $R_2$, and $R_3$ may be the same or different radical selected from the group consisting of phenyl, cresyl, xylyl, toluyl, isopropylphenyl, tertiary butylphenyl, tertiary nonylphenyl and secondary butylphenyl; and (c) about 5 to about 30 weight percent of a carboxylic ester nonionic surfactant selected from the group consisting of the anhydrosorbitol ester type and the glycerol ester type.

13. A metal working lubricant consisting essentially of:

(a) about 60 to about 90 weight percent of a polyol ester derived from esterification of an aliphatic polyol with aliphatic carboxylic acid;

(b) about 1 to about 10 weight percent of a triaryl phosphate represented by the formula:

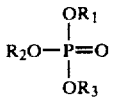

wherein $R_1$, $R_2$, and $R_3$ may be the same or different radical selected from the group consisting of phenyl, cresyl, xylyl, toluyl, isopropylphenyl, tertiary butylphenyl, tertiary nonylphenyl and secondary butylphenyl; and (c) about 5 to about 30 weight percent of a carboxylic ester nonionic surfactant selected from the group consisting of the anhydrosorbitol ester type and the glycerol ester type.

* * * * *